United States Patent [19]

Bradshaw

[11] 3,982,515

[45] Sept. 28, 1976

[54] EXHAUST GAS RECIRCULATION CONTROL ASSEMBLY

[75] Inventor: Cyril E. Bradshaw, Kalamazoo, Mich.

[73] Assignee: Eaton Corporation, Cleveland, Ohio

[22] Filed: Apr. 26, 1974

[21] Appl. No.: 464,379

[52] U.S. Cl. ..... 123/119 A

[51] Int. Cl.[2] ..... F02M 25/06

[58] Field of Search ..... 123/119 A; 137/489, 137/492.5; 251/28, 61.1

[56] References Cited

UNITED STATES PATENTS

| | | | |
|---|---|---|---|
| 3,756,210 | 9/1973 | Kuehl | 123/119 A |
| 3,762,384 | 10/1973 | Day et al. | 123/119 A |
| 3,783,848 | 1/1974 | Ranft et al. | 123/119 A |
| 3,799,131 | 3/1974 | Bolton | 123/119 A |
| 3,802,402 | 4/1974 | Swatman | 123/119 A |
| 3,834,366 | 10/1974 | Kingsbury | 123/119 A |
| 3,880,129 | 4/1975 | Hollis, Jr. | 123/119 A |

*Primary Examiner*—Wendell E. Burns
*Assistant Examiner*—David D. Reynolds
*Attorney, Agent, or Firm*—Teagno & Toddy

[57] ABSTRACT

A valve assembly is provided for controlling the recirculation of exhaust gas in an internal combustion engine. The assembly comprises body means defining a first chamber containing vacuum, and a second chamber exposed to air at substantially atmospheric pressure. A means is provided for communicating between the first chamber and the second chamber including first valve means for controlling the flow of air from the second chamber into the first chamber in response to variations in the pressure of the exhaust gas, and a pressure responsive control means is subjected to the pressure in one of the chambers. The assembly further includes an exhaust gas inlet and an exhaust gas outlet and a second valve means disposed between the inlet and the outlet, the valve means being operatively associated with the pressure responsive means to be controlled by the movement of the pressure responsive means. A passage means is in open communication between the exhaust gas inlet and the first valve means which, preferably, includes a valve member defining an orifice communicating between the first chamber and the second chamber. A control means is provided and is movable in response to variations in exhaust gas pressure between two positions spaced apart from the valve member.

5 Claims, 1 Drawing Figure

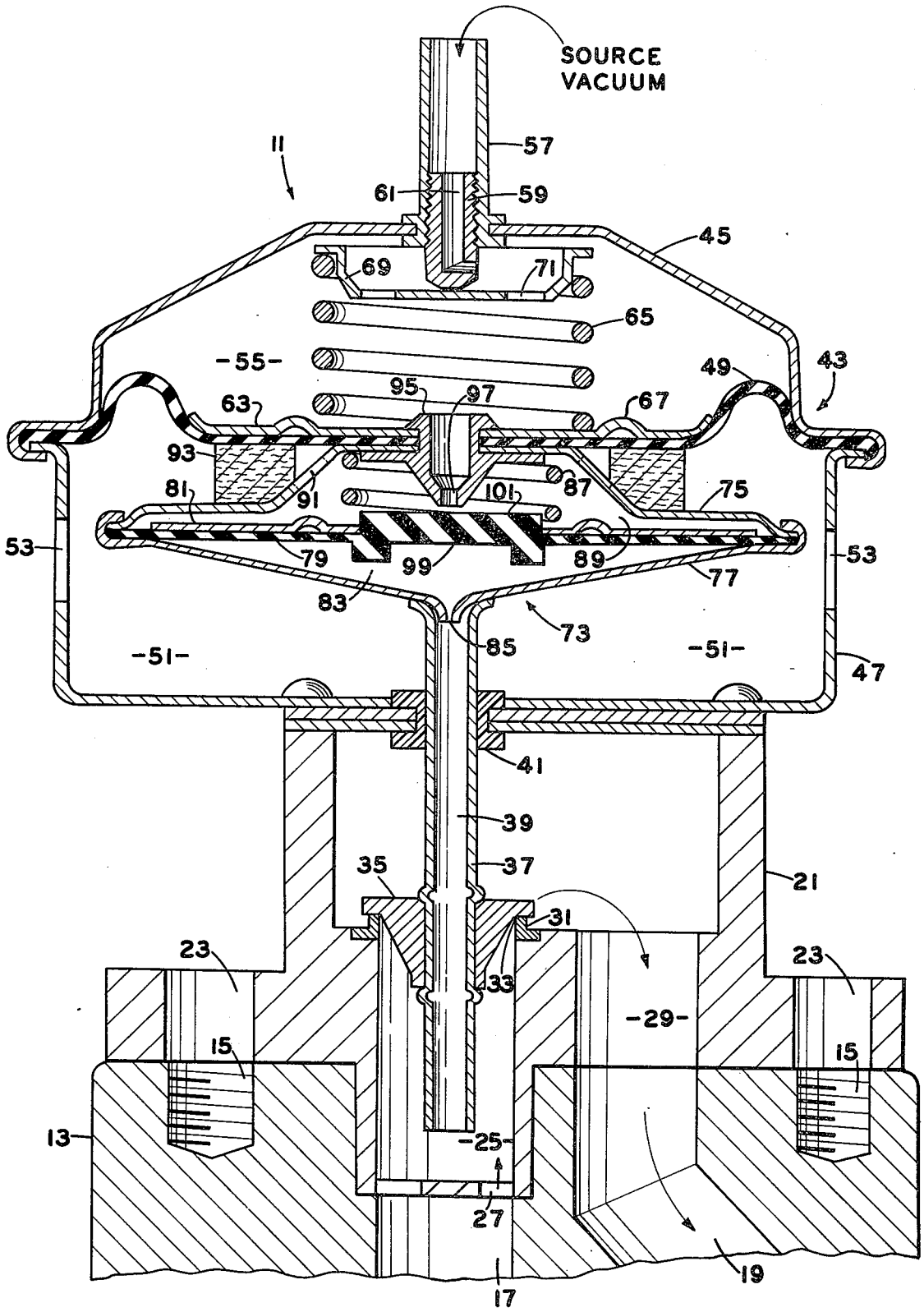
SOURCE
VACUUM
11
57
61
59
45
69
71
65
-55-
49
43
95
97
63
67
93
91
101
87
75
81
53
79
99
89
53
77
83
73
85
-51-
-51-
47
41
39
35
37
21
31
23
33
23
-29-
15
15
13
-25-
27
17
19

EXHAUST GAS RECIRCULATION CONTROL ASSEMBLY

BACKGROUND OF THE DISCLOSURE

The present invention relates to a valve assembly for recirculating exhaust gases in an internal combustion engine, and more particularly, to such an assembly which combines an exhaust gas back-pressure transducer and an EGR (exhaust gas recirculation) valve.

The use of EGR valves generally involves the recirculation of the exhaust gases at a rate approximately proportional to the rate at which air flows into the engine. Such valves have been made responsive to the vacuum in either the intake manifold or the carburetor or, in some cases, have been made responsive to the position of the throttle.

An example of a prior art combination EGR valve and exhaust gas back-pressure transducer is illustrated in U.S. Pat. No. 3,756,210. The reference patent illustrates a valve assembly in which exhaust gas back-pressure (positive gauge pressure) is applied against a diaphragm connected to a slide valve, so that when the pressure reaches a predetermined level, the diaphragm moves, sliding the valve to the open position. The opening of the valve permits vacuum from the intake manifold to enter a chamber which is generally at atmospheric pressure. The incoming vacuum reduces the pressure within the chamber, causing the movement of a second diaphragm connected to the EGR valve member. The reduced pressure moves the diaphragm, opening the EGR valve and permitting exhaust gas to flow to the intake manifold through the passages used to communicate vacuum to the valve assembly.

Because of the use of a common passage for both the vacuum and the recirculated exhaust gas, the valve assembly of the cited reference may tend to oscillate rapidly between the "open" and "closed" positions, because each time the EGR valve opens, the vacuum needed to keep it open is suddenly mixed with exhaust gas at a positive pressure. In the prior art device described, such oscillation is especially undesirable because the valve utilized to permit the passage of vacuum into the control chamber must rapidly slide back and forth between the "open" and "closed" valve positions. The resulting sliding friction represents an operating load within the valve assembly, which tends to cause erratic and less reliable operation and necessitates larger and stronger diaphragms, biasing springs, and other members.

SUMMARY OF THE INVENTION

Accordingly, it is an object of the present invention to provide a valve assembly for recirculating exhaust gas which is able to keep the exhaust gas "datum" back-pressure more constant, to maintain the ratio of exhaust gas to air into the intake manifold more constant.

It is a related object of the present invention to provide an EGR valve assembly which is simplified and has minimum frictional operating loads to permit the operation of the valve to be more sensitive, thereby reducing the operating response time.

It is another related object of the present invention to provide an EGR valve assembly in which the vacuum controlling the operation of the EGR valve is continually modulated, in response to the exhaust gas pressure, by controlling a source of air rather than oscillating between an open condition and a closed condition.

It is also an object of the present invention to provide such a valve assembly in which the source vacuum or control vacuum communicating between the intake manifold and the valve assembly is kept separate from the recirculated exhaust gas.

These and other objects of the present invention which will become apparent upon a reading of the following detailed description are accomplished by the provision of an improved valve assembly for controlling the recirculation of exhaust gas in an internal combustion engine. The valve assembly comprises a valve body defining a first chamber containing vacuum, and a second chamber exposed to air at atmospheric pressure. A means is provided communicating the first chamber with the second chamber and including a first valve means for controlling the flow of air from the second chamber into the first chamber in response to variations in the pressure of the exhaust gas, and a pressure responsive control means is subjected to the pressure in one of the chambers. The valve body further defines an exhaust gas inlet and an exhaust gas outlet, and a second valve means is disposed between the inlet and the outlet, the second valve means being operatively associated with the pressure responsive means to be controlled by the movement thereof, and a passage means is in open communication between the exhaust gas inlet and the first valve means.

In accordance with another aspect of the present invention the first valve means includes a valve member defining an orifice communicating between the first chamber and the second chamber and a control means movable, in response to variations in exhaust gas pressure, between a first position spaced apart from the valve member at a first distance and a second position spaced apart from the valve member at a second distance, the second distance being greater than the first distance.

In accordance with still another aspect of the present invention, the second valve means includes an exhaust gas recirculation orifice, a valve seat means, a valve member adapted to be received in the valve seat means for controlling the flow of exhaust gas through the orifice, and a valve stem member movable with the valve member and having a passage in open communication between the exhaust gas inlet and the first valve means.

DESCRIPTION OF THE PREFERRED EMBODIMENT

Referring now to the drawing FIGURE, which is for the purpose of illustrating a preferred embodiment of the present invention, and not for limiting the same, there is illustrated an EGR valve assembly, generally designated 11, which may, for example, be bolted to the upper surface of a manifold portion or boss 13. The manifold portion 13 includes a pair of bolt-receiving bores 15, a passage 17 containing exhaust gas from the exhaust manifold at a positive pressure, and a passage 19 for communicating recirculated exhaust gas to the intake manifold.

The valve assembly 11 includes an EGR valve housing 21 defining a pair of bolt bores 23 aligned with bolt-receiving bores 15. The valve housing 21 further includes an exhaust gas inlet 25 in open communication with passage 17 through opening 27. Adjacent the inlet 25 is an exhaust gas outlet 29 in open communication with the passage 19. At the upper end of the exhaust gas inlet 25 is a valve seat member 31 defining an EGR orifice 33. Received within the seat 31 for closing the EGR orifice 33 is a valve member or poppet 35 which is movable with, and in the subject embodiment, fixedly attached to a hollow, tubular valve stem member 37 having an exhaust gas passage 39 extending therethrough. The stem member 37 is slidably received within a seal member 41, preferably made from a material having a low heat transfer coefficient, such as asbestos.

Attached to the upper portion of valve housing 21 is a control housing 43, including a control housing upper portion 45 and a control housing lower portion 47. Disposed between the upper portion 45 and the lower portion 47 is a pressure responsive, flexible diaphragm 49 which separates the control housing into a lower chamber 51 exposed to atmospheric air through a series of inlets 53, and an upper vacuum chamber 55. The chamber 55 is in communication with source vacuum through an outer vacuum fitting 57 and an inner vacuum fitting 59, threadedly engaging the fitting 57, and defining a vacuum passage 61. The upper surface of the diaphragm 49 is in engagement with a reinforcing plate 63, which maintains the flat configuration of the central portion of the diaphragm 49. The diaphragm 49 and reinforcing plate 63 are biased downwardly by biasing spring 65, which is seated at its lower end against the plate 63 within the upwardly-protruding portion 67 of plate 63. The spring 65 is seated at its upper end against spring seat member 69 which includes a plurality of vacuum orifices 71 communicating between the vacuum passage 61 and the vacuum chamber 55. The biasing force of spring 65 may be adjusted by rotating the inner vacuum fitting 59, which is in contact with the spring seat member 69.

Disposed within the air chamber 51 is a transducer assembly 73 comprising an upper member 75 and a lower member 77. Disposed between the members 75 and 77 is a pressure responsive diaphragm 79 with a reinforcing plate 81 attached to the upper surface thereof. The diaphragm 79 cooperates with lower member 77 to define an exhaust gas chamber 83, the lower member 77 preferably defining a damping or attenuating orifice 85 for attenuating the exhaust gas pressure within the gas chamber 83. The diaphragm 79 and reinforcing plate 81 are biased downwardly by biasing spring 87, seated at its lower portion against reinforcing plate 81, and at its upper portion against transducer upper member 75. The diaphragm 79 and reinforcing plate 81 cooperate with the upper member 75 to define an air chamber 89 which communicates with the main air chamber 51 through a plurality of air passages 91, permitting air to flow into the chamber 89 after passing through a filter 93.

Positioned to communicate between air chambers 51 and 89 and vacuum chamber 55 is a bleed valve member 95 defining an air bleed passage 97. The bleed valve member 95 further serves to constrain reinforcing plate upper member 75, trapping diaphragm 49 therebetween in air-tight, sealing engagement. Diaphragm 79 includes an enlarged, central control plate or control portion 99 having an upper surface 101, maintained in a spaced-apart relation with the bottom of bleed valve member 95 by the counter-acting forces of the biasing spring 87 and the exhaust gas pressure within the chamber 83. In the preferred embodiment, the gap between the control surface 101 and bleed valve member 95 is maintained within a range of about 0.012 inches (0.30 mm) to about 0.036 inches (.91 mm), the gap restricting the flow of air from chamber 89 through the air bleed passage 97 to regulate or modulate the vacuum level within vacuum chamber 55.

OPERATION

As shown in the drawing, the valve assembly 11 is in its neutral position, i.e., the valve member 35 is engaging the valve seat 31, and the control surface 101 is at approximately the maximum separation from the bleed valve member 95 to permit maximum air flow into the vacuum chamber 55. In the subject embodiment, a vacuum level of about 2–4 inches (5.08–10.08 cm) of mercury is required in the vacuum chamber 55 in order for the atmospheric pressure in chamber 51 to overcome the biasing force of spring 65 and raise the diaphragm 49, thereby lifting transducer assembly 73 and the valve stem member 37 and valve member 35 connected thereto. Thus, in the neutral condition illustrated, the vacuum level in chamber 55 is less than about 2 inches (5.08 cm) of mercury. The source vacuum, shown entering through vacuum fitting 57, may be manifold vacuum downstream from the throttle plate, but preferably, is venturi suction, taken from a location in the carburetor bore which is closed off by the butterfly when the butterfly is closed. Thus, the term "induction passage" is intended to include any such source of vacuum.

The datum back-pressure (DBP), i.e., the positive gauge pressure exerted by the exhaust gas in the exhaust gas inlet 25, flows through the exhaust gas passage 39 in the valve stem 37, through the damping orifice 85 and into the exhaust gas chamber 83 to exert a positive pressure against the underside of diaphragm 79 and especially, on the underside of the control plate 99. When the pressure exerted by the exhauast gas rises above the predetermined DBP level, a sufficient force is exerted on the diaphragm 79 to move it upward so that control surface 101 is closer to the bleed valve member 95, thereby restricting the flow of air from air chamber 89 through the air bleed passage 97. This restriction of air flow causes the vacuum level in chamber 55 to increase (i.e., to a more negative range pressure) above a predetermined level (2 inches or 5.08 cm of mercury in the subject embodiment), with the result that the biasing force of spring 65 is overcome as described previously, and the valve member 35 is lifted from the valve seat 31 to permit exhaust gas to pass through the exhaust gas orifice 33, through the interior of housing 21 and out the exhaust gas outlet 29.

It should be noted that because the transducer assembly 73 and bleed valve member 95 move together with the diaphragm 49, the operation of the entire valve assembly is continuously responsive to changes in both the exhaust gas pressure and the vacuum level in chamber 55. If the exhaust gas pressure in the inlet 25 and in the chamber 83 now drops, as a result of a decrease in the engine load, or partially because the back-pressure has been relieved by the opening of the valve 35, the reduction in exhaust gas pressure permits the control surface 101 to move toward to its original position, at the greater separation from the bleed valve member 95. This increase in the gap permits a greater flow of air into the vacuum chamber 55, thus causing the vacuum level to drop below the predetermined actuation level (i.e., to a less negative gauge pressure), so that the biasing spring 65 biases the diaphragm toward its neutral position, thus returning the valve member 35 to its neutral position in engagement with the valve seat 31.

It will be understood from the foregoing description of the construction and operation of the valve assembly that, within the scope of the present invention, the specific arrangement of diaphragms and chambers could be varied. For example, the relative positions of the air chamber 51 and vacuum chamber 55 could be reversed. Therefore, the important features of the present invention include the communication of datum back-pressure with the means for controlling the flow of air through the bleed valve member 95 and valve means for modulating the pressure in the vacuum chamber which provides continuous modulation rather than an "on-off" condition.

The invention has been described in detail sufficient to enable one of ordinary skill in the art to make and use the same. Obviously, modifications and alterations of the preferred embodiments will occur to others upon a reading and understanding of the specification and it is my intention to include all such modifications and alterations as part of my invention insofar as they come within the scope of the appended claims.

I claim:

1. An exhaust gas recirculation controller of the type having structure defining an exhaust gas inlet and an exhaust gas outlet for recirculating exhaust gas in an internal combustion engine, said controller comprising:

a. housing means defining a vacuum chamber including first port means adapted for communicating with a source of vacuum, second port means communicating said vacuum chamber with the atmosphere;

b. first pressure responsive means disposed within said housing and movable in response to changes in vacuum in said chamber;

c. valve means operative to control communication of said exhaust gas inlet with said exhaust gas outlet, said valve means including a valve seat and a movable poppet;

d. means movably disposed within said housing means and defining an exhaust gas chamber including second pressure responsive means operatively movable in response to changes in exhaust gas pressure in said exhaust gas chamber for controlling flow of atmospheric air through said second port means; and e. hollow stem means defining an exhaust gas passage continuously communicating said exhaust gas inlet with said exhaust gas chamber wherein said passage passes axially through said movable poppet and said hollow stem means is operable to move said poppet in response to movement of said first pressure responsive means.

2. The controller defined in claim 1, wherein:

a. said vacuum responsive means includes means defining an orifice comprising said second port means; and b. said means for controlling atmospheric air flow includes plate means movable with said second exhaust gas pressure-responsive means for controlling air flow through said orifice.

3. The controller defined in claim 1, wherein said means defining said exhaust gas chamber is attached to and movable with said first pressure responsive means.

4. An exhaust gas recirculation control valve assembly for an internal combustion engine having an exhaust gas passage and an exhaust gas recirculation passage, said assembly comprising:

a. valve body means including, i. an exhaust gas chamber including an inlet for receiving exhaust gas from the exhaust gas passage and an outlet for discharging exhaust gas to the exhaust gas recirculation passage, ii. a vacuum chamber including a source vacuum inlet;

b. means movably disposed within said body means and defining a control chamber;

c. valve means disposed between said exhaust gas inlet and said exhaust gas outlet and including a valve seat, a valve member movable with respect to said valve seat for controlling the flow of exhaust gas through said exhaust gas chamber, said hollow stem means operatively movable with said valve member;

d. said stem means having the interior thereof in open communication through said valve member and between said exhaust gas inlet and said control chamber; and e. control means operatively connected with said stem means, said control means including, i. a first pressure responsive member disposed between said vacuum chamber and said control chamber defining means and first means biasing said valve member toward engagement with said valve seat, ii. bleed valve means defining an air bleed orifice in open communication between the atmosphere and said vacuum chamber, and iii. a second pressure responsive member disposed within said control chamber defining means and second means biasing said member toward a normally spaced-apart relation with said bleed orifice to permit atmospheric air to pass through said air bleed passage into said vacuum chamber, said second pressure responsive member being subjected to exhaust gas pressure tending to overcome said second biasing means and move said second pressure responsive member closer to said bleed valve means, reducing the flow of atmospheric air into said vacuum chamber.

5. A valve assembly for controlling the recirculation of exhaust gas in an internal combustion engine, comprising:

a. body means defining a vacuum chamber and an atmospheric air chamber;

b. a diaphragm disposed between said vacuum chamber and said atmospheric air chamber and responsive to the pressure differential between said vacuum chamber and said atmospheric air chamber;

c. said body means further defining an exhaust gas inlet and an exhaust gas outlet and including valve means responsive to movement of said diaphragm for controlling flow between said inlet and outlet;

d. a pressure transducer assembly disposed within said first atmospheric air chamber and mounted for movement with said diaphragm, said transducer assembly defining an exhaust gas chamber;

e. a pressure responsive member disposed within said transducer and said exhaust gas chamber and being movable in response to pressure changes in said exhaust gas chamber;

f. means defining an exhaust gas passage in open comunication between said exhaust gas chamber and said exhaust gas inlet;

g. means defining an air bleed passage in open communication between said vacuum chamber and said atmospheric air chamber; and h. said pressure responsive member being movable between first and second positions spaced-apart from said air-bleed-passage-defining means, said pressure responsive member including a central portion defining a substantially planar control surface cooperating with said air-bleed-passage-defining means to control the flow of air from said atmospheric air chamber to said vacuum chamber.

* * * * *

Disclaimer 3,982,515.—*Cyril E. Bradshaw*, Kalamazoo, Mich. EXHAUST GAS RECIRCULATION CONTROL ASSEMBLY. Patent dated Sept. 28, 1976. Disclaimer filed June 13, 1978, by the assignee, *Eaton Corporation.*

Hereby enters this disclaimer to claims 1 through 5 of said patent.

[*Official Gazette August 8, 1978.*]